United States Patent [19]

Eklund et al.

[11] Patent Number: 5,040,012

[45] Date of Patent: Aug. 13, 1991

[54] EXTENDED X-RAY FILM DEVELOPMENT CONTROLLER

[75] Inventors: G. W. Eklund, Peona; Dale Surratt, Chillicothe; David A. DeFrance, Jr., Bellevue; Daniel E. Koonce, Mackinaw, all of Ill.

[73] Assignee: Advanced Radiographic Technologies, Inc., Peoria, Ill.

[21] Appl. No.: 494,445

[22] Filed: Mar. 16, 1990

[51] Int. Cl.[5] ..... G03D 3/08

[52] U.S. Cl. ..... 354/321

[58] Field of Search ..... 354/319, 320, 321, 322

[56] References Cited

U.S. PATENT DOCUMENTS

| | | | |
|---|---|---|---|
| 1,860,212 | 5/1932 | Sullivan | 354/321 |
| 4,385,821 | 5/1983 | Kachelries | 354/319 |
| 4,903,100 | 2/1990 | Kogane et al. | 354/322 |

*Primary Examiner*—L. T. Hix
*Assistant Examiner*—Le Nguyen
*Attorney, Agent, or Firm*—Emrich & Dithmar

[57] ABSTRACT

A controller for operating an X-ray film processor at reduced speed for extended film developing includes a push-button selector coupled to a voltage regulator for providing a precisely regulated, reduced voltage to a variable speed dc drive motor for operation at slower speeds. The controller also includes override circuitry for preventing selection of one processing speed during operation at another speed to avoid improper film processing. Indicator lights are also provided to inform an operator of the mode of operation, i.e., normal or slow speed, of the film processor as well as the cumulative amount of film processed at each speed. The controller provides a continuous range of reduced operating speeds for improved contrast and image resolution and is adapted for installation as a kit with existing single speed X-ray film processors to provide a dual speed capability by a plug-in connection to existing electrical leads.

8 Claims, 1 Drawing Sheet

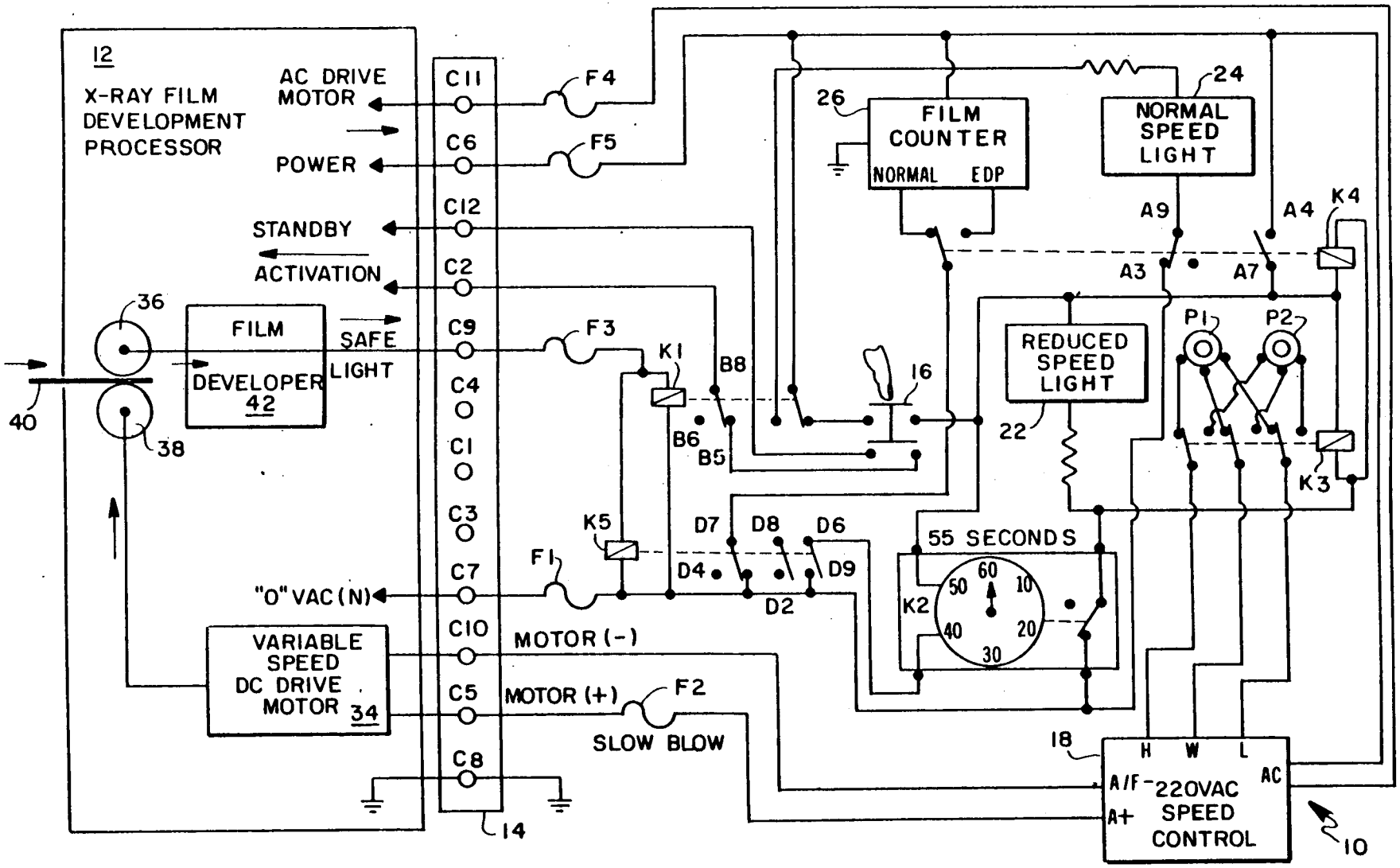
NORMAL SPEED LIGHT
REDUCED SPEED LIGHT
FILM COUNTER
NORMAL
EDP
55 SECONDS
220VAC SPEED CONTROL
AC
L
W
H
A/F
A+
MOTOR (-)
MOTOR (+)
SLOW BLOW
AC DRIVE MOTOR
POWER
STANDBY
ACTIVATION
SAFE LIGHT
"O" VAC (N)
VARIABLE SPEED DC DRIVE MOTOR 34
FILM DEVELOPER 42
X-RAY FILM DEVELOPMENT PROCESSOR 12

EXTENDED X-RAY FILM DEVELOPMENT CONTROLLER

FIELD OF THE INVENTION

This invention relates generally to the development of X-ray film and is particularly directed to a controller for an X-ray film development processor. High contrast radiography and high resolution image detail are important requisites for soft tissue imaging, especially mammography. Mammographers, using film/screen imaging, have depended heavily on a radiation absorption grid to achieve higher contrast by reducing scatter radiation. The price paid for use of the grid to achieve enhanced image contrast is higher radiation to the patient. Use of lower voltage and higher current settings will also provide enhanced contrast, but at the expense of greater radiation dose.

BACKGROUND AND SUMMARY OF THE INVENTION

The use of extended developer processing time (EDPT) for selected radiographic procedures can significantly enhance image detail and allow discrimination of subtle abnormalities with slight density differences. This phenomenon has been widely promoted by Dr. Lazslo Tabar as an important factor in processing single emulsion mammographic images. The dramatic improvement in contrast permits lower current settings and reduces the need for a grid for most mammographic studies. Mammography is not the only radiography procedure to benefit from EDPT. All soft tissue radiography requiring high contrast and extremity studies requiring fine bony trabecular detail can reap the benefits of this technology, whether using single or double emulsion film.

The great benefit of low voltage, single emulsion, film/screen mammography is the markedly improved contrast and image detail. When combined with small focal spots and molybdenum targets, the resulting monochromatic X-ray beam and sharp image detail provides an exceptional ability to discriminate very small objects with slight density differences. In general, the lower the voltage, the higher the contrast. The lower the voltage, the higher the current required to achieve the same film exposure. Thus, the trade off for lower voltage is higher radiation dose. Extended developer processing time can offset this need for higher current by maximizing the density of the developed image and at the same time, increasing image contrast. The result is a reduction in radiation dose (lower current and/or voltage) with enhanced contrast.

High contrast images are especially important in soft tissue radiography, such as extremity and neck films in search of foreign bodies, and neck soft tissues for evaluation of airway disease. Xeroradiography has been the accepted standard for these applications. Many institutions that have converted to film/screen mammography, continue to use Xeroradiography for these soft tissue examinations. Those without Xerographic equipment have used conventional radiographic units with standard 90 second processing, with or without some of the higher contrast films, to evaluate soft tissues. Such techniques fall short of the optimal contrast and detail possible with EDPT.

Rheumatologists are aware of the excellent bone images showing fine trabecular detail obtained with mammographic equipment, especially when using magnified small focal spot (0.1 mm) techniques. The higher radiation requirements for these studies have discouraged mammographers from subjecting their mammographic X-ray tubes to the resulting added wear and tear. Images obtained with overhead tubes using larger focal spots (0.6 to 1.2 mm) and single emulsion films can provide good soft tissue detail, but with the addition of EDPT, contrast and image detail are markedly improved. The resulting reduction in radiation requirements when EDPT is available, reduces the wear and tear on X-ray tubes, making the use of smaller focal spot mammographic equipment more feasible for soft tissue and bone detail films of the hands and feet.

Advantages derived with EDPT capability for mammography and selected soft tissue and fine bone detail studies include the following:

1. Improved contrast and image detail.
2. Lower radiation dose to the patient.
3. Elimination of the need to maintain an expensive second imaging technology just for soft tissues in those institutions that have converted to film/screen mammography.
4. Significant reduction in "wear and tear" on X-ray tubes used for these procedures. In other words, longer tube life and reduced overhead.
5. Added imaging capability and improved service to referring clinicians.

Accordingly, it is an object of the present invention to provide improved X-ray film development when used on soft tissue such as in mammography.

It is another object of the present invention to provide existing single speed X-ray film processors with a dual speed capability for improved X-ray image detail and resolution.

Yet another object of the present invention is to provide an easily installed, inexpensive kit for retrofit installation in existing single speed X-ray developers to provide an extended developer processing time.

Still another object of the present invention is to provide a continuous range of reduced speeds for an X-ray film developer for improved contrast and image detail.

A further object of the present invention is to provide an extended development processing capability in existing single speed X-ray film processors at a very modest cost with the added benefits of reduced radiation exposure to the patient and prolonged life of expensive X-ray tubes.

Although new processors are available with dual speed controls that allow processing at the usual 90 seconds and/or EDPT, the cost of replacing an existing processor or adding one of these dual speed units is substantial and frequently prohibitive. Few facilities can afford the luxury of a dedicated processor just for EDPT. A cost effective alternative is the relatively inexpensive EDPT conversion kit of the present invention which can be easily installed by any processor servicing technologist. This device modifies existing processors to run any given film at the standard 90 seconds or any preselected extended developer processing time. The conversion unit is available for most Kodak processors and may be adaptable to other manufacturers, units also. With the conversion of a typical busy processor, handling over 400 sheets of film daily, the converted processor is capable of processing a mix of mammographic, soft tissue and bone detail films with EDPT together with conventional radiographic films processed at 90 seconds. Films processed at different speeds can be alternated. Selection of EDPT for a given film is made simply by the press of a button on an illuminated panel indicating the development time. The unit immediately reverts to 90 second mode when the EDPT film leaves the developer, resulting in no significant delay between films. If the unit is being used primarily for films processed with EDPT, the "standard"0 mode can be set for EDPT with push-button selection for the 90 second mode.

BRIEF DESCRIPTION OF THE DRAWING

The FIGURE is a simplified combined schematic and block diagram of an extended X-ray film development controller in accordance with the present invention.

DETAILED DESCRIPTION OF THE PREFERRED EMBODIMENT

Referring to the FIGURE, there is shown in simplified schematic and block diagram form an extended X-ray film development controller 10 in accordance with the principles of the present invention. The controller 10 is adapted for use with a conventional X ray film development processor 12 and electrically coupled thereto by means of a multi-pin connector 14.

The X-ray film development processor 12 may be conventional in design and operation and typically includes a pair of rollers 36 and 38 which form a portion of a transport arrangement for X-ray film 40 inserted in the film development processor. A series of such rollers displaces the X-ray film 40 into and through a film developer stage 42 within the processor 12. The film developer stage 42, which also typically includes a fixer stage (not shown for simplicity), develops the exposed X-ray film to provide an image of the viewed object. The transport rollers 36, 38 are rotationally displaced by a variable speed DC drive motor 34 in accordance with the present invention which replaces a prior art synchronous AC motor. Speed changes in development rates are accomplished with a gear change using the aforementioned constant speed synchronous AC motor. As a result, the film developing speed of prior art processors can only be varied in an incremental manner in accordance with preset operating speeds and contrast and image resolution of the developed X-ray films are of limited quality.

The extended X-ray film development controller 10 includes an operator responsive selector 16 in the form of a single throw, double pole switch. Prior to user engagement selection of the selector 16, the X-ray film development processor 12 operates at normal speed. In this mode of operation, the controller 10 is invisible and passive with respect to the X-ray film development processor 12 in that it merely routes the AC drive motor power provided to pins C6 and C11 on connector 14 back to the processor for operating the variable speed DC drive motor 34 at normal speed. A 220 VAC input is provided from pins C11 and C6 the connector 14 to a speed control circuit 18 which, in turn, provides a DC output for operating the drive motor 34 at normal speed. The speed control circuit 18 may be conventional in design and operation, with either a Dart or Leeson voltage regulator used in a preferred embodiment for providing a precisely regulated voltage to the motor so it operates at a constant speed.

Upon engagement of the selector 16, relays K3 and K4 are energized. During normal speed operation, a first potentiometer P1 is coupled to the speed control circuit 18 for providing a voltage reference thereto. The speed control circuit 18 uses this voltage reference to precisely control the normal operating speed of the X-ray film development processor 12. Following actuation of relay K3, the first potentiometer P1 as disconnected from the speed control circuit 18 and a second potentiometer P2 is coupled in circuit thereto. The second potentiometer P2 provides a reduced reference voltage to the speed control circuit 18 which, in turn, provides a reduced voltage to the variable speed DC drive motor 34 for operating the X-ray film development processor 12 in an extended development mode of operation in accordance with the present invention. Both potentiometers P1 and P2 are of the continuously adjustable type, permitting the normal operating speed as well as the slower development speed of the processor 12 to be established from a range of such speeds. By permitting continuous adjustment of the reduced operating speed of the X-ray film development processor 12 over a wide range of such reduced speeds, X-ray film development may be precisely adjusted to accommodate changes in various system parameters such as film sensitivity, film developer activity, etc., to permit film image contrast and resolution to be adjusted for optimum viewing.

Operator engagement of selector 16 also actuates timer relay K2. Actuation of timer relay K2 turns on a reduced speed light 22 for providing a visual indication to the operator that the X-ray film development processor 12 is operating at a reduced speed. Actuation of relay K4 following engagement of selector 16 extinguishes a normal speed light 24 by de-energizing it via contacts A3 and A9, while simultaneously switching the reduced speed light 22 in circuit via contacts A4 and A7. Thus, engagement of the selector 16 causes the reduced speed light 22 to illuminate and the normal speed light 24 to go out. In a preferred embodiment, the timer relay K2 times out after 55 seconds. A film counter 26 measures and displays the extent of operation of the X-ray film projector at the first normal speed and at the second slower speed.

When the X-ray film 40 is inserted between rollers 36 and 38, a SAFE light signal is extinguished. The SAFE light signal is generated by and available in most conventional X-ray film development processors and indicates that X-ray film is currently entering the processor. The SAFE light is illuminated by the signal when there is no X-ray film in the film development processor 12 which indicates to an operator that the processor is ready for developing. With the X-ray film 40 disposed between the rollers 36 and 38, the SAFE light is extinguished and relay K1 within the controller 10 is actuated. Turn-off of the SAFE light signal also actuates relay K5 within the controller 10. Actuation of relay K5 resets timer relay K2 via contacts D6 and D9 of the relay. Thus, upon engagement of selector 16, timer relay K2 begins counting down and causes the illumination of the reduced speed light 22 and turn-off of the normal speed light. When X-ray film 40 is inserted between rollers 36 and 38 for reduced speed processing, the SAFE light signal is removed and relay K5 is actuated for re-setting second timer relay K2 which again begins its timing countdown. Thus, relay K5 ensures that the controller 10 will remain in the extended film processing mode of operation for at least another 55 seconds (or whenever timer relay K2 times out). This lock-out feature thus prevents overriding of the extended film development mode during slower processing of X-ray film.

Relay K1 is also actuated by removal of the SAFE light signal and also provides a timing function in the extended X-ray film development controller 10. Following removal of the SAFE light signal, relay K1 provides a 20 second lock-out feature which prevents selection of the extended processing mode of operation during normal processing of X-ray film. When timer relay K1 is actuated, its contacts B5, B6 and B8 disconnect the selector 16 from the circuit and prevent the entry of a reduced processing speed command. In a preferred embodiment, timer relay K1 times out after 20 seconds, thus preventing the entry of a new input command via selector 16 for this time period.

Removal of the SAFE light signal output from the X-ray film development processor 12 also actuates relay K5 which, via its contacts D6 and D9 re-sets relay timer K2. Thus, upon introduction of X-ray film 40 into the rollers 36 and 38, the second relay timer K2 is again triggered preventing the entry via selector 16 of another development speed control input signal. The override features of relays K1 and K2 thus prevent the entry of a developer speed input control command via selector 16 and preclude improper processing of film being developed.

There has thus been shown an extended X-ray film development controller for operating an X-ray film processor at reduced speed for extended film developing. The controller is adapted for direct interfacing with existing X-ray processor installations without modification and permits the reduced speed to be precisely established and selected from a continuous range of such speeds for improved contrast and image resolution. The controller includes various interlock/override features which prevent the entry of processor speed change input commands during film processing and further provides various visual indications of X-ray film processor operation.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. For use with an X-ray film processor including a film transport and development arrangement and characterized by a first normal operative speed, a controller for operating the film processor at a second slower speed and extending the developing time of the X-ray film for improved contrast and image detail, said controller comprising:

operator responsive selector means for selecting an extended X-ray film developing time;

variable speed drive means coupled to the transport and development arrangement;

voltage regulation means coupled to said selector means and responsive to selection of an extended X-ray film developing time for providing a reduced voltage to said drive means and operating the film transport and development arrangement at a slower speed in extending X-ray film developing time, wherein said reduced voltage may be continuously varied over a predetermined voltage range to permit the slower speed of the film transport and development arrangement to be selected over a range of such slower speeds; and lock-out means coupled to the transport and development arrangement and responsive to the operation thereof for preventing overriding of the extended developing time until the X-ray film is processed at the second slower speed.

2. The controller of claim 1 further comprising visual display means for indicating that the X-ray film processor is operating at the first normal speed or the second slower speed.

3. The controller of claim 1 further comprising counter means for measuring and displaying the extent of operation of the X-ray film processor at the first normal speed and at the second slower speed.

4. The controller of claim 1 wherein said voltage regulation means includes a first potentiometer for providing a reference voltage to said variable drive means at the first normal operating speed of the X-ray film processor.

5. The controller of claim 4 further comprising a second, continuously variable potentiometer for providing a reduced voltage to said drive means at the second slower speed of the X-ray film processor.

6. The controller of claim 1 wherein said lock-out means includes timer means for preventing actuation of said selector means for a predetermined time period following insertion of X-ray film in the film transport and development arrangement.

7. The controller of claim 6 wherein said timer means includes a first timer countdown relay for preventing actuation of the X-ray film processor for a predetermined time following insertion of X-ray film in the film transport and development arrangement.

8. The controller of claim 7 wherein said timer means further includes a second timer countdown relay for preventing said voltage regulation means from providing a reduced voltage to said drive means for a predetermined time period following insertion of X-ray film in the film transport and development arrangement.

* * * * *